US005568839A

United States Patent [19]

Campbell

[11] Patent Number: 5,568,839

[45] Date of Patent: Oct. 29, 1996

[54] REINFORCED BORING ROD ASSEMBLY AND METHOD OF FORMING SAME

[76] Inventor: Sammy Campbell, 541 Buffalo Shoals Rd., Statesville, N.C. 28677

[21] Appl. No.: 399,559

[22] Filed: Mar. 7, 1995

[51] Int. Cl.[6] ..... E21B 17/00

[52] U.S. Cl. ..... 175/320; 29/508; 29/517

[58] Field of Search ..... 175/320, 325.1; 285/382, 382.7; 29/506, 515, 516, 517, 508

[56] References Cited

U.S. PATENT DOCUMENTS

| | | | |
|---|---|---|---|
| 2,741,498 | 4/1956 | Elliott . | |
| 3,554,306 | 1/1971 | Wilburn | 175/417 |
| 4,371,199 | 2/1983 | Kushner et al. | 285/382.5 |
| 4,626,001 | 12/1986 | Lee | 285/94 |
| 4,679,828 | 7/1987 | Bernardot | 285/175 |
| 4,745,983 | 5/1988 | Moorehead et al. | 175/320 |
| 4,832,382 | 5/1989 | Kapgan | 285/369 |
| 4,836,586 | 6/1989 | Martin | 285/382.7 |
| 5,007,667 | 4/1991 | Unewisse et al. | 285/382.2 |

*Primary Examiner*—William P. Neuder
*Attorney, Agent, or Firm*—Shefte, Pinckney & Sawyer

[57] ABSTRACT

A reinforced boring rod assembly and a method for producing the same includes a boring rod including an arrangement for mounting a rod end thereto, a rod end for mounting to the boring rod, a generally annular collar telescopically mounted around the boring rod adjacent the mounting arrangement with the collar including a plurality of crimps formed circumferentially thereabout and extending into the rod a sufficient distance to initiate gripping action on the rod end. Stainless steel welds cover the crimps as well as the junctions of the rod end and the collar, as well as the collar and the boring rod. A method for constructing the same is also disclosed.

14 Claims, 5 Drawing Sheets

REINFORCED BORING ROD ASSEMBLY AND METHOD OF FORMING SAME

BACKGROUND OF THE INVENTION

The present invention relates broadly to earth boring equipment and, more particularly, to a reinforced earth boring rod assembly and a method for producing the same.

The installation of utilities, such as underground electrical cable and cable television, typically involve horizontal boring, known also as "moleing." This operation consists of utilizing rotating lengths of segmented drive rods which are powered from an above-ground power source to drive a drill bit or compaction head.

The drive rods are fixed at one end with a continuation segment which may be a hex-shaped female end or a hex-shaped male end for receipt within the female end. Either of these rods may be mounted, typically by welding, to an existing boring rod to provide a link thereby rod segments may be joined. Further, the compaction head or boring bit may be inserted in a female end portion.

During use, such rods are typically affected by twisting forces due to the resistance of the earth as the power source rotates the driving rod as well as bending forces due to rod movement along its length and compressive forces as the rod is forced inwardly into the earth. These forces can weaken the junction between rod end and the boring rod segment. In addition, heat applied during the welding of the junction between the drive rod and the rod end can weaken the soft steel material of the drive rod. Heretofore, such boring rods have been noted for their ability to fail during field operations which can be time consuming and typically results in increased expense for the boring operation.

SUMMARY OF THE INVENTION

It is accordingly an object of the present invention to provide a reinforced boring rod assembly which addresses the above-discussed problems.

More specifically, it is an object of the present invention to provide a reinforced boring rod assembly and a method for producing the rod assembly which results in a rod of enhanced structural strength and commensurate resistance to failure.

To that end, a reinforced earth boring rod assembly includes a rod for horizontal earth boring having an assembly for mounting a rod end thereonto; a rod end mounted to the rod end mounting assembly; a generally annular collar telescopically mounted to the boring rod adjacent the mounting assembly, the collar having a plurality of crimps formed therein at predetermined circumferentially spaced locations around the collar with the crimps extending inwardly a distance sufficient to deform at least a portion of the boring rod and defining a plurality of circumferentially spaced indentations around the collar.

Preferably, the rod end includes a mounting spindle projecting outwardly from an end portion thereof and the boring rod defines a longitudinally extending axis and includes a generally cylindrical, hollow spindle receiving mounting portion formed therein, the rod end being mounted to the boring rod with its spindle inserted into the spindle receiving mounting portion. It is further preferred that the crimps are longitudinally extending furrows that are longer than their width and extend inwardly sufficient to deform an inner surface of the spindle receiving mounting portion for gripping action on the spindle. Preferably, the indentations are filled to the collar surface with a stainless steel weld. Further, the present invention may include a welding bead formed circumferentially around the boring rod at a junction of the collar and the boring rod. It is further preferred that all welds associated with the present invention be formed of stainless steel.

The method of the present invention includes the steps of providing a rod for horizontal earth boring with the rod having an assembly for mounting a rod end thereto; providing a rod end for mounting to the boring rod; placing a generally annular collar telescopically around the boring rod adjacent the mounting assembly; mounting a rod end to the boring rod adjacent the collar; welding the rod end to the collar; creating a plurality of crimps in the collar at predetermined circumferentially spaced locations around the collar with the crimps deforming at least a portion of the boring rod and defining a plurality of circumferentially spaced indentations around the collar; and filling the indentations with a weld bead.

Preferably, the step of providing a rod end includes providing a rod end having a mounting spindle projecting outwardly from an end portion thereof, the step of providing a boring rod includes providing a boring rod having a generally cylindrical, hollow spindle receiving mounting portion formed therein, and the step of mounting the rod end to the boring rod includes mounting the rod end spindle in the spindle receiving mounting portion. Further, the step of creating crimps includes creating crimps which deform an inner surface of the spindle receiving mounting portion for gripping action on the spindle.

It is further preferred that the method include the step of welding a reinforcement bead circumferentially around the boring rod at the junction of the collar and the boring rod. It is further preferred that the step of forming the reinforcement bead includes welding the rod using a stainless steel weld. It is also preferred that all welding steps include forming the weld using stainless steel.

By the above, the present invention provides a reinforced earth boring rod assembly which is not weakened by heat during assembly and is resistant to destruction due to twisting forces or bending forces.

Further, due to the collar diameter being larger than the rod diameter, the collar contacts the inner walls of any hole bored using the present invention and thereby reduces wear on the rod. Additionally, due to the stability imparted to the rods, separations occur less frequently and the rods are easier to manually separate.

DETAILED DESCRIPTION OF THE PREFERRED EMBODIMENT

Figure 1:
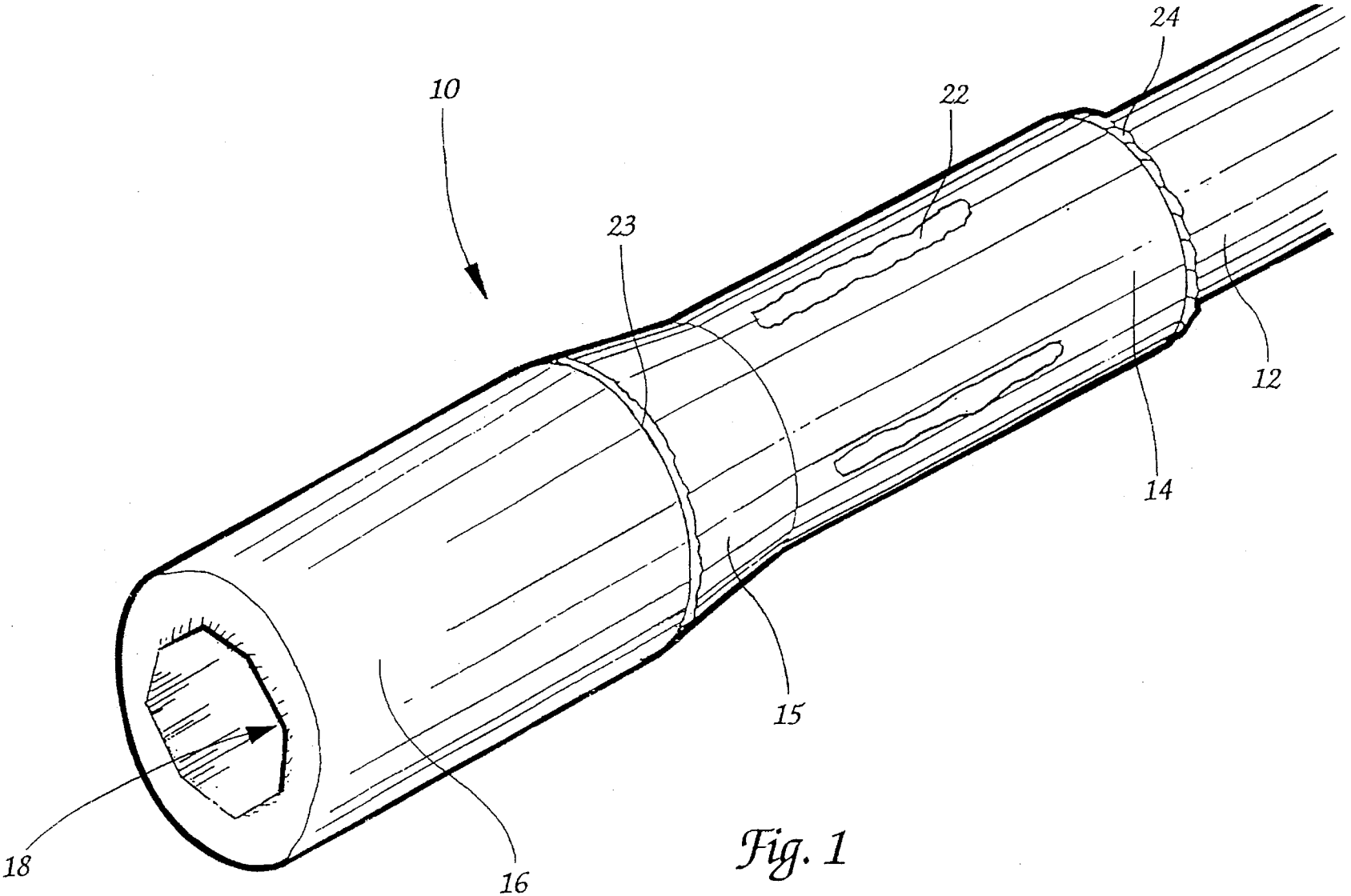
FIG. 1 is a perspective view of a reinforced earth boring rod assembly in accordance with the preferred embodiment of the present invention.
Figure 3:
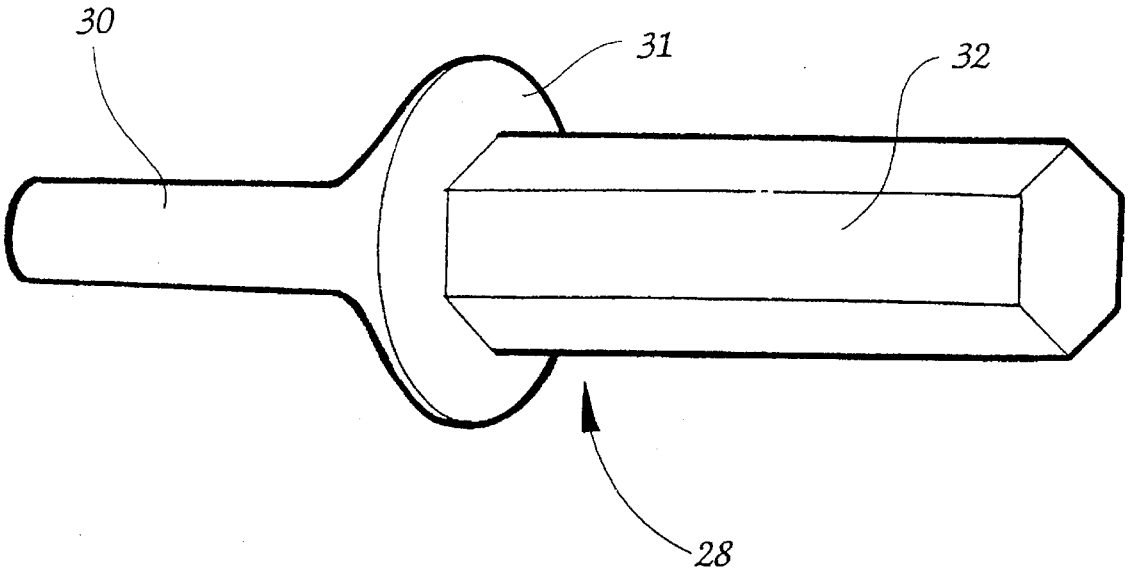
FIG. 3 is a perspective view of a male rod end used with the present invention.

Turning now to the drawings and more particularly to FIG. 1, a reinforced boring rod assembly according to the preferred embodiment of the present invention is illustrated generally at 10 and includes a generally elongate boring rod 12, a generally cylindrical collar 14 having the boring rod 12 mounted telescopically therein, and a female rod end 16 mounted to the boring rod 12 and collar 14. As illustrated in FIG. 1, the female rod end 16 includes a generally hexagonal opening 18 for receipt of a male rod end 28 as illustrated in FIG. 3 or drill bits (not shown).

Figure 4:
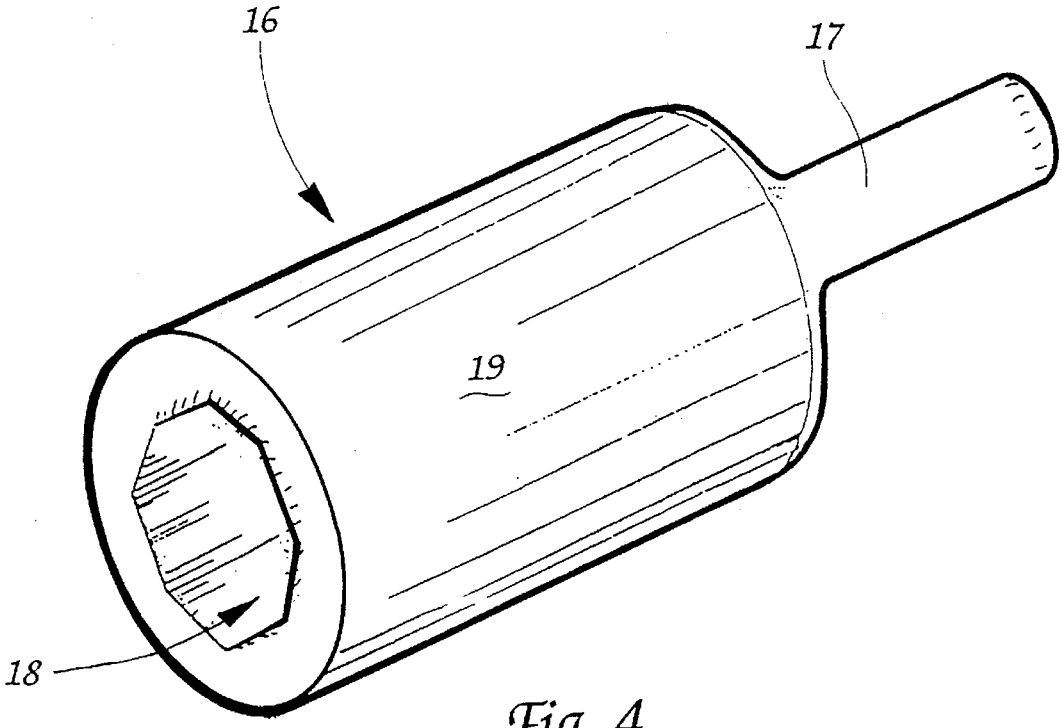
FIG. 4 is a perspective view of a female rod end as used with the present invention.
Figure 5:
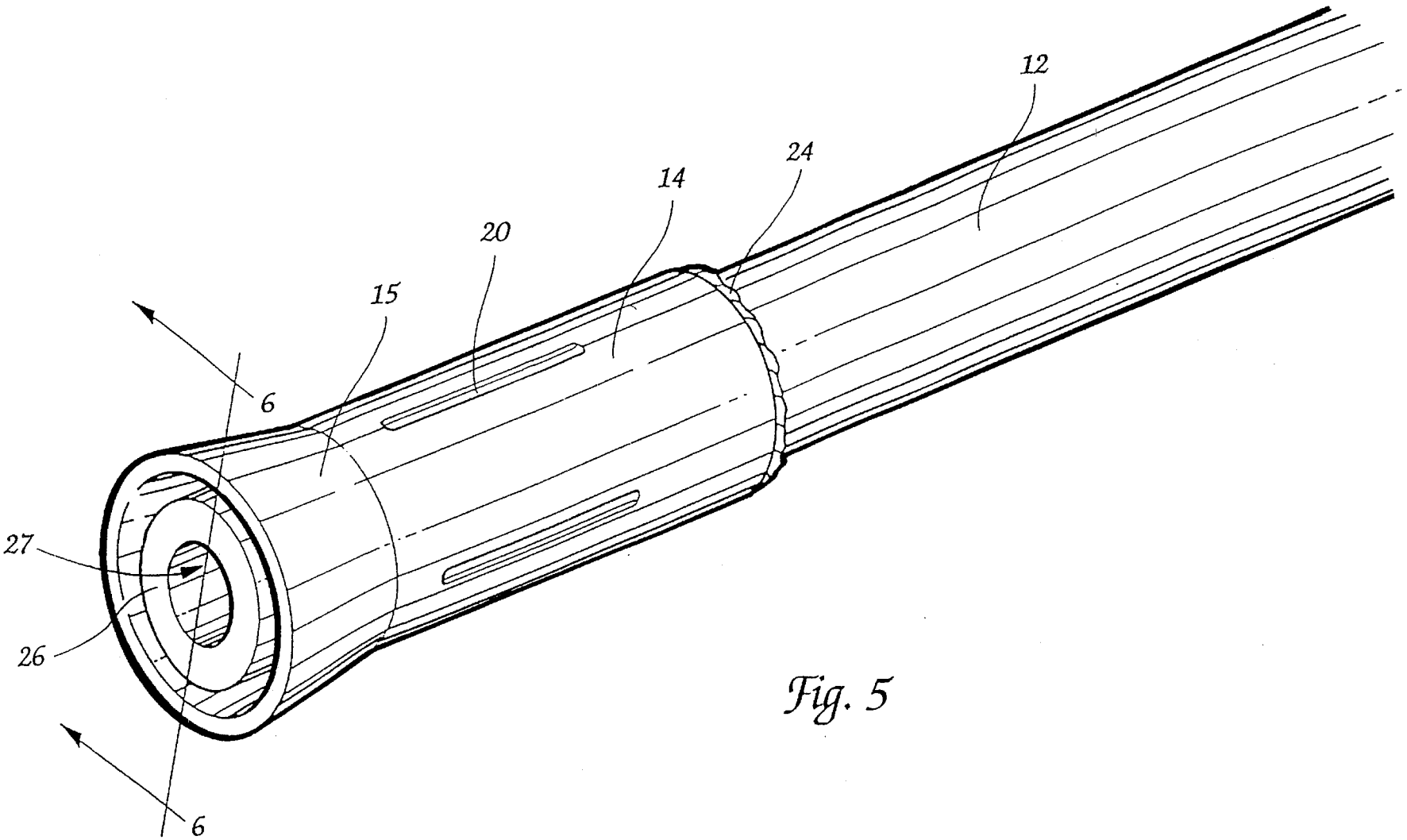
FIG. 5 is a perspective view of a boring rod according to the present invention during an intermediate step of assembly.

The basic reinforcing structure of the boring rod assembly 10 of the present invention is illustrated in FIG. 5 during a preliminary step in the method of forming the present invention. The rod illustrated in FIG. 5 is configured for receipt of either a male rod end 28, as illustrated in FIG. 3, or a female rod end 16, as illustrated in FIG. 4. With reference to FIG. 3, the male rod end 28 includes a generally cylindrical spindle portion 30 projecting outwardly from a conical base 31 in a first longitudinally extending direction and a male hex-shaped portion 32 extending oppositely from the spindle 30. As seen in FIG. 4, a female rod end 16 includes a hexagonally configured receiving opening 18 formed in a rod end body 19 with a generally cylindrical spindle 17 projecting outwardly therefrom. If one of each rod end 16,28 is mounted to separate boring rods, the rods may be mated together by insertion of the male portion 32 into the hex-shaped female opening 18. Accordingly, the segmented rods may be united end to end during the earth boring operations.

Turning now to FIG. 5, the boring rod assembly of the present invention is shown at an intermediate stage of construction. At one end thereof, the boring rod 12 includes an end mount arrangement 26 formed at one end thereof including a hollow cylindrical portion having a spindle receiving opening 27 formed therein. The spindle receiving opening 27 is configured for receipt of a mounting spindle 30 from the male rod end 28 as seen in FIG. 3 or a mounting spindle 17 from the female rod end 16 as seen in FIG. 4. Mounting of the rod ends 16,28 will be discussed in greater detail hereinafter.

In order to provide a shield, a generally cylindrical collar 14 is fitted around the end of the rod 12 adjacent the mounting portion 26. The collar is preferably formed of stainless steel and includes a flared portion 15 extending in an outwardly flared direction away from the body of the boring rod 12. In order to retain the collar 14 in place, a plurality of longitudinally extending crimps 20 are formed as furrows in the collar 14. The crimps 20 may be formed using a punch press machine.

Figure 6:
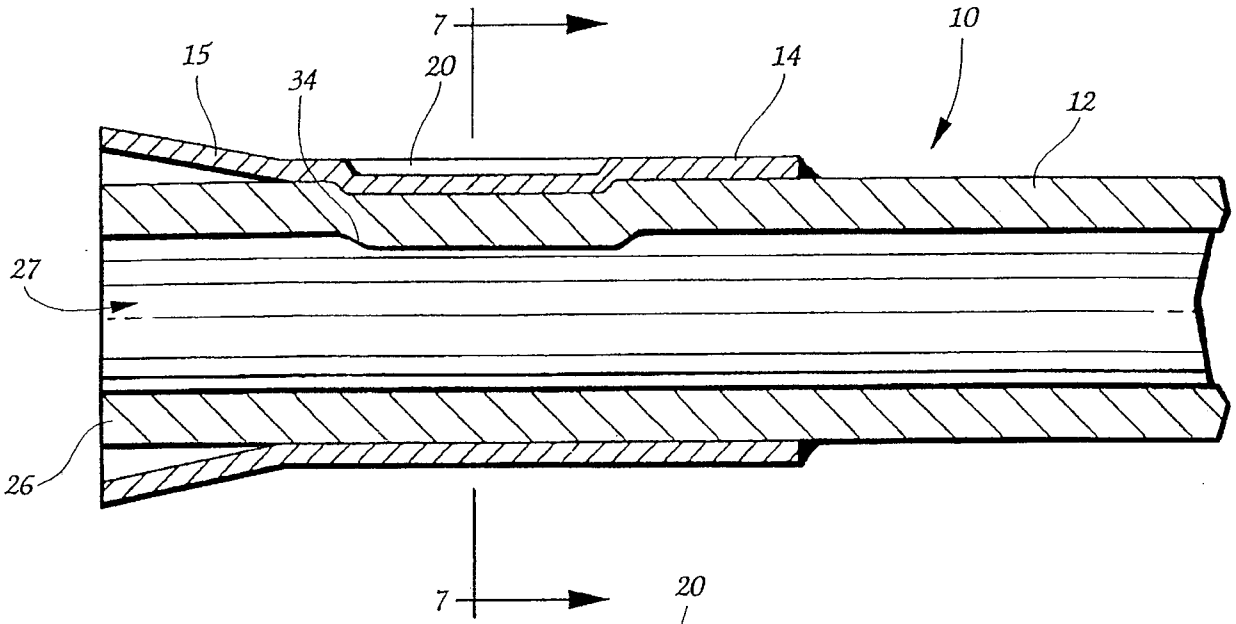
FIG. 6 is a side cross-sectional view of the boring rod assembly illustrated in FIG. 5 taken along lines 6—6 thereof.
Figure 7:
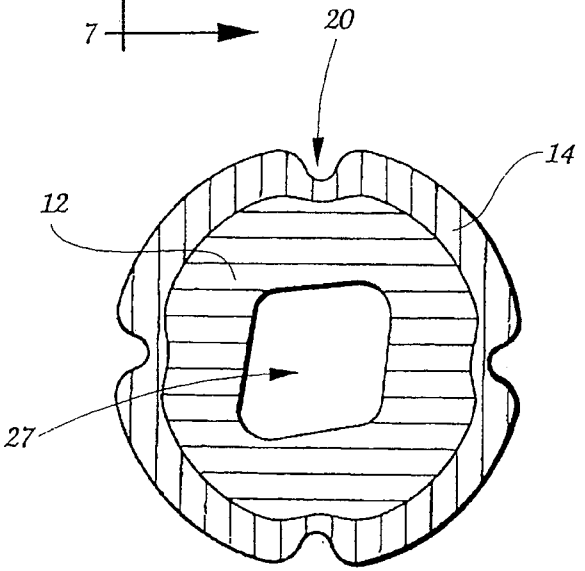
FIG. 7 is an end cross-sectional view of the boring rod assembly illustrated in FIG. 6 and taken along lines 7—7 thereof.

As seen in FIG. 6, the longitudinally extending crimps 20 are formed of a sufficient depth that they deform the boring rod 12 with the deformed rod portions 34 extending into the spindle receiving opening 27. This intrusion is also illustrated in FIG. 7 as an end-on cross-section.

Referring back to FIG. 1, the assembly includes some additional welds. A forward circumferential stainless steel weld bead 23 is formed around the junction between the outer surface of the rod end 16 and the flared portion 15 of the collar 14. A rearward stainless steel weld bead 24 is formed at the junction of the collar 14 and the boring rod 12. Finally, the crimps 20 are filled to the collar surface with a stainless steel weld 22. This weld 22 acts to prevent obstructions from entering the indentations formed by the crimps and placing undue torque on a rotating boring rod. Further, the stainless steel welds reinforce the metal weakened by crimp formation and act as an overall strengthening agent for the rod.

Figure 2:
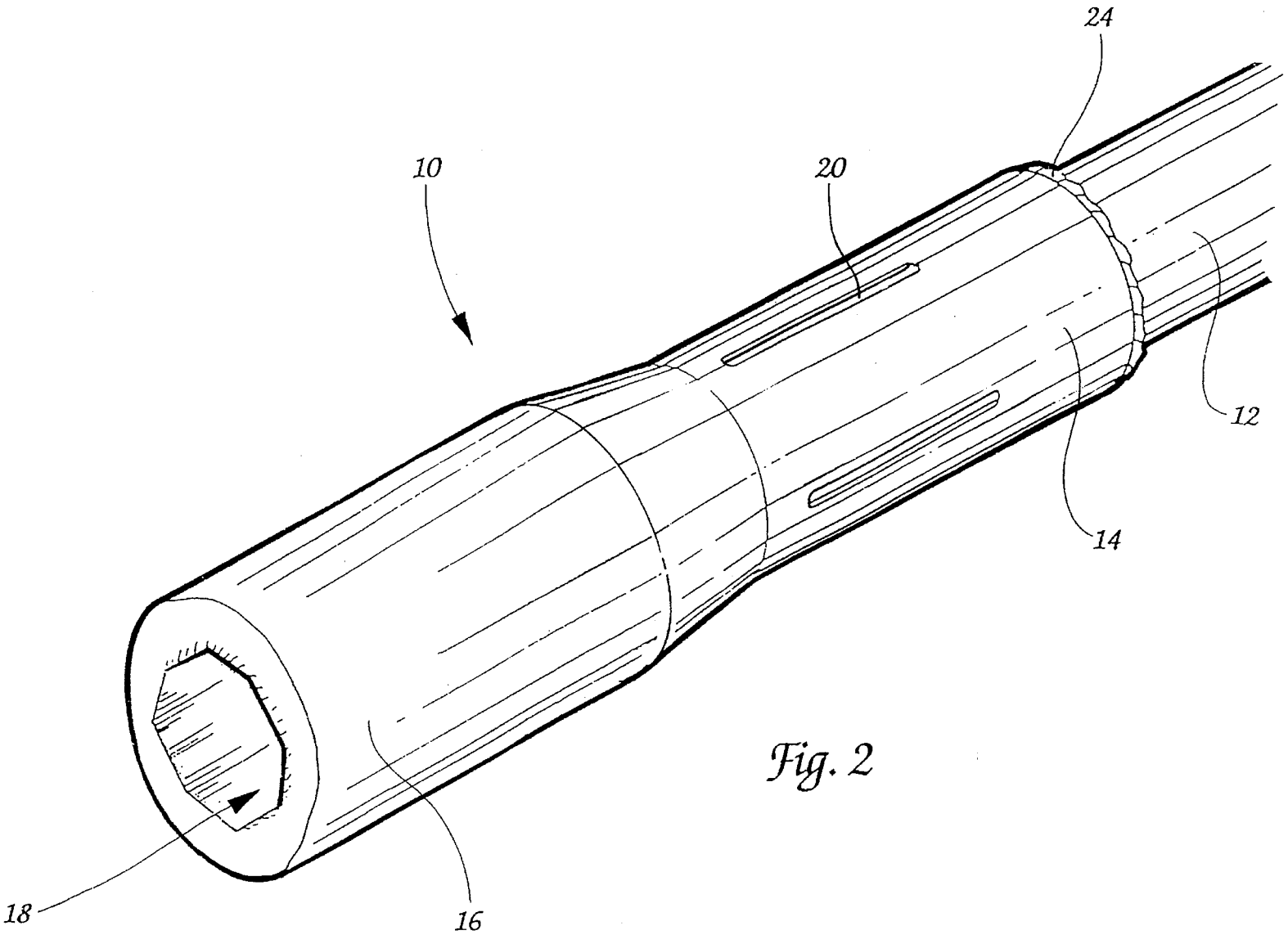
FIG. 2 a perspective view of the reinforced boring rod assembly illustrated in FIG. 1 during an intermediate step of assembly.

According to the method of the present invention, a boring rod 12 is provided and, as seen in FIG. 5, the collar is placed on the rod 12 in telescopic manner. The rod end is then chosen and either a female rod end 16 or male rod end 28 is selected. The spindle of the respective rod end is inserted in the spindle receiving opening 27 and the collar 14 positioned to abut the rod end 16,28 as seen in FIG. 2. The rear weld bead 24 is then formed to retain the collar in place. Next, the crimps 20 are formed using a punch press with the deformation extending inwardly as seen in FIGS. 6 and 7. Next, and as seen in FIG. 1, stainless steel is welded into the crimped indentations 20 to form a smooth surface 22 which is typically even with the surface of the collar 14. Finally, the rod end 16 is welded at its junction with the flared portion 15 of the collar 14 circumferentially therearound.

It should be noted that, while the present invention contemplates a conventional stainless steel weld, some of the welds could be accomplished by so-called nurse welding. This involves a surface weld where two metals are mixed together with one metal being in powder form and the other metal being the recipient welded member. The powder is placed on the piece, the piece is spun to the point of heating, and the weld is formed once the spinning is stopped. Further, it will be recognized by those skilled in the art that the present invention has application beyond the instant application disclosed herein.

By the above, the present invention provides a reinforced boring rod assembly which overcomes the problems inherent in the prior art. The rod is stronger due to its physical construction configuration as well as its method of assembly which results in less application of heat to the softer metal rod which tended to weaken the rod and cause it to be brittle. Accordingly, underground boring operations will be able to continue with fewer broken connecting rods.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A method for producing a reinforced boring rod assembly comprising the steps of:

providing a rod for horizontal earth boring, the rod having means for mounting a rod end thereto;

providing a rod end for mounting to said boring rod;

placing a generally elongate annular collar telescopically around said boring rod adjacent said mounting means;

mounting a rod end to said boring rod adjacent said collar using said mounting means;

welding said rod end to said collar;

creating a plurality of longitudinally extending crimps in said collar at predetermined circumferentially spaced locations around the collar with said crimps deforming at least a portion of said boring rod and defining a plurality of circumferentially spaced indentations around the collar; and filling said indentations to a collar surface with a weld bead.

2. A method according to claim 1 wherein the step of providing a rod end includes providing a rod end having a mounting spindle projecting outwardly from an end portion thereof, the step of providing a boring rod includes providing a boring rod having a generally cylindrical, hollow spindle receiving mounting portion formed therein, the step of mounting said rod end to the boring rod includes mounting said rod end spindle in said spindle receiving mounting portion and the step of creating crimps includes creating crimps which deform an inner surface of said spindle receiving mounting portion for gripping action on said spindle.

3. A method according to claim 1 and further comprising the step of welding a reinforcement bead circumferentially around the boring rod at a junction of said collar and the boring rod.

4. A method according to claim 1 wherein said step of welding the reinforcement bead includes welding the rod using a stainless steel weld.

5. A method according to claim 1 wherein all welding steps include forming the weld using stainless steel.

6. A method according to claim 1 wherein said boring rod defines a longitudinally extending axis and said crimps are formed as longitudinally extending furrows which are longer than their width.

7. A reinforced earth boring rod assembly comprising:

a rod for horizontal earth boring having means for mounting a rod end thereinto;

a rod end mounted to said rod end mounting means;

a generally annular, elongate collar telescopically mounted to said boring rod adjacent said mounting means, said collar having a plurality of longitudinally extending crimps formed therein at predetermined circumferentially spaced locations around said collar, said crimps extending inwardly a distance sufficient to deform at least a portion of said boring rod and defining a plurality of circumferentially spaced indentations around said collar.

8. A reinforced earth boring rod assembly according to claim 7 wherein said rod end includes a mounting spindle projecting outwardly from an end portion thereof, said boring rod includes a generally cylindrical, hollow spindle receiving mounting portion formed therein, said rod end is mounted to said boring rod with its spindle inserted into said spindle receiving mounting portion, and said crimps extend inwardly sufficient to deform an inner surface of said spindle receiving mounting portion for gripping action on said spindle.

9. A reinforced earth boring rod assembly according to claim 7 wherein said indentations are filled to a collar surface with stainless steel welds.

10. A reinforced earth boring rod assembly according to claim 7 and further comprising a welding bead formed circumferentially around said boring rod at a junction of said collar and said boring rod.

11. A reinforced earth boring rod assembly according to claim 8 wherein said weld bead is formed from stainless steel.

12. A reinforced earth boring rod assembly according to claim 1 wherein all welds are formed with stainless steel.

13. A method according to claim 7 wherein said boring rod defines a longitudinally extending axis and said crimps are formed as longitudinally extending furrows which are longer than their width.

14. A reinforced earth boring rod assembly according to claim 7 and further comprising a reinforcement bead disposed circumferentially around the boring rod at a junction of said collar and said boring rod.

* * * * *